United States Patent [19]

Murphy

[11] Patent Number: 4,581,244

[45] Date of Patent: Apr. 8, 1986

[54] CURING OF SURFACE COATINGS

[75] Inventor: Gerald J. Murphy, Bangor, Australia

[73] Assignee: Apptech Equipment Pty., Limited, Belmore, Australia

[21] Appl. No.: 674,159

[22] PCT Filed: Mar. 9, 1984

[86] PCT No.: PCT/AU84/00041

§ 371 Date: Nov. 5, 1984

§ 102(e) Date: Nov. 5, 1984

[87] PCT Pub. No.: WO84/03458

PCT Pub. Date: Sep. 13, 1984

[30] Foreign Application Priority Data

Mar. 11, 1983 [AU] Australia ..... PF8412

[51] Int. Cl.[4] ..... B05D 1/04; B05D 3/02

[52] U.S. Cl. ..... 427/27; 427/248.1; 427/337; 427/340; 427/348; 427/377; 427/378

[58] Field of Search ..... 427/340, 348, 337, 248.1, 427/377, 378, 27; 118/63

[56] References Cited

U.S. PATENT DOCUMENTS

| | | | |
|---|---|---|---|
| 3,678,890 | 7/1972 | Ehrensing et al. | 118/63 |
| 4,066,801 | 1/1978 | Hoyer et al. | 118/63 X |
| 4,366,193 | 12/1982 | Linden et al. | 427/340 |
| 4,442,143 | 4/1984 | Reed | 427/340 |

*Primary Examiner*—Thurman K. Page

*Attorney, Agent, or Firm*—Charles R. Mattenson; John T. Winburn

[57] ABSTRACT

This invention relates to improvements in and relating to curing of surface coatings and has been devised particularly though not solely for the curing of surface coatings such as paints or inks.

7 Claims, 2 Drawing Figures

CURING OF SURFACE COATINGS

BACKGROUND ART

In the past it has been known to cure a surface coating such as a coating of paint or ink by applying a vapour phase material to the coating, containing a catalyst which reacts with the coating to at least initiate the curing thereof. Such coatings may typically comprise synthetic polymers which are cured by the formation of long chains with cross-linking, accelerated by the catalyst contained in the vapour phase material.

In this specification the term "catalyst" will be used to refer to any suitable substance capable of use in a vapour phase for impingement onto a coating for accelerating and/or initiating curing of the coating.

Examples of methods for accelerating curing of the coatings of the type referred to above are to be found in the following patent specifications:

Australian 476,431

Australian 445,242 and U.S. equivalent U.S. Pat. No. 3,874,898

U.S. Pat. No. 2,892,734 (L. C. Hoffman)

U.S. Pat. No. 2,657,151 (H. Gensel)

U.S. Pat. No. 4,294,021 (J. O. Turnbull et al.)

U.S. Pat. No. 3,851,402 (J. O. Turnbull et al.)

U.S. Pat. No. 4,331,782 (G. L. Linden)

U.S. Pat No. 2,810,662 (H. L. Barnebey)

U.S. Pat. No. 3,874,948 (S. S. Kertel)

U.S. Pat. No. 4,343,924 (G. L. Linden)

U.S. Pat. No. 4,343,839 (J. R. Blegen)

The range of coatings with which the present invention is concerned is not restricted to but includes by way of example paint-like coatings such as urethane-resinous hybrid based paints, and printing inks.

It is a disadvantage of the curing of surface coatings by the application of vapour phase materials containing a catalyst, that while the coating so "cured" is nominally touch-dry after the application of the vapour phase material, the sub-surface layers of the coating may not yet be fully cured and a considerable time is necessary for a full cure of the surface coating. This time may delay further handling or packaging, etc., of the article to which the surface coating has been applied and results in inconvenience or delays which may be expensive in a manufacturing situation.

It is therefore an object of the present invention to provide a method of and apparatus for curing a coating on a substrate which will obviate or minimise the foregoing disadvantage in a simple yet effective manner, or which will at least provide the public with a useful choice.

DISCLOSURE OF INVENTION

Accordingly in one aspect the invention consists in a method of curing a coating on a substrate wherein at least the initiation of the curing is achieved by the application of a catalyst, characterised by the step of applying a gas blast to the coating after the application of the catalyst substantially removing remaining and/or unused catalyst from the coating.

In a further aspect the invention consists in apparatus for curing a coating on a substance, said apparatus comprising first means adapted to apply a vapour phase material containing a catalyst to the coating for the predetermined period of time, the apparatus being characterised by second means adapted to subsequently apply a gas blast to the coating to substantially remove catalyst from the coating.

Surprisingly, it has been found that relatively small proportions of "catalyst" material remaining on the coating can substantially delay curing of the coating and furthermore, at least in some circumstances, can prevent the coating ever forming its intended characteristics. In particular, the coating could form a skin thereby preventing the coating properly curing throughout its thickness with resultant great disadvantage.

Most importantly, use of the invention can improve the reliability of coating methods and provide rapid curing which will be very significant economically.

Preferably, for maximum convenience and economy the gas glast is an air blast which has been found successful with a range of synthetic polymer coatings and preferably the blast has a velocity greater than 1.5 meters per second.

It is considered that a highly effective and advantageous velocity to be employed in use of the present invention is a velocity in the range of 1.5 to 8 meters per second and most advantageously the blast is applied at on acute angle to the surface of the coating, to rapidly and effectively remove catalyst by a scouring action.

In a preferred embodiment of the invention, the method also extends to include applying the catalyst material in a vapour phase to a coating on a substrate by causing impingement on the coating of the catalyst at a substantially higher velocity than has hitherto been thought appropriate; more specifically, this further inventive development consists in applying the vapour phase catalyst at a velocity of at least 1.5 meters per second whereby effective penetration of the coating occurs and the catalyst material becomes available at reactive sites in the coating.

The length of time over which each step of the method should be conducted will depend upon the particular coatings employed and typically the initial step of subjecting the coating to vapour phase catalysts would have a time in the region of two minutes and the second step of applying the gas blast would occupy several minutes, typically 4 to 10 minutes.

According to another aspect of the invention, there is provided a coated product produced by the method as described in any one of the forms above.

BRIEF DESCRIPTION OF DRAWINGS

Notwithstanding any other forms that may fall within its scope, one preferred form of the invention and variations thereof will now be described by way of example only with reference to the following examples and to the accompanying drawings, in which.

MODES FOR CARRYING OUT THE INVENTION

Figure 1:
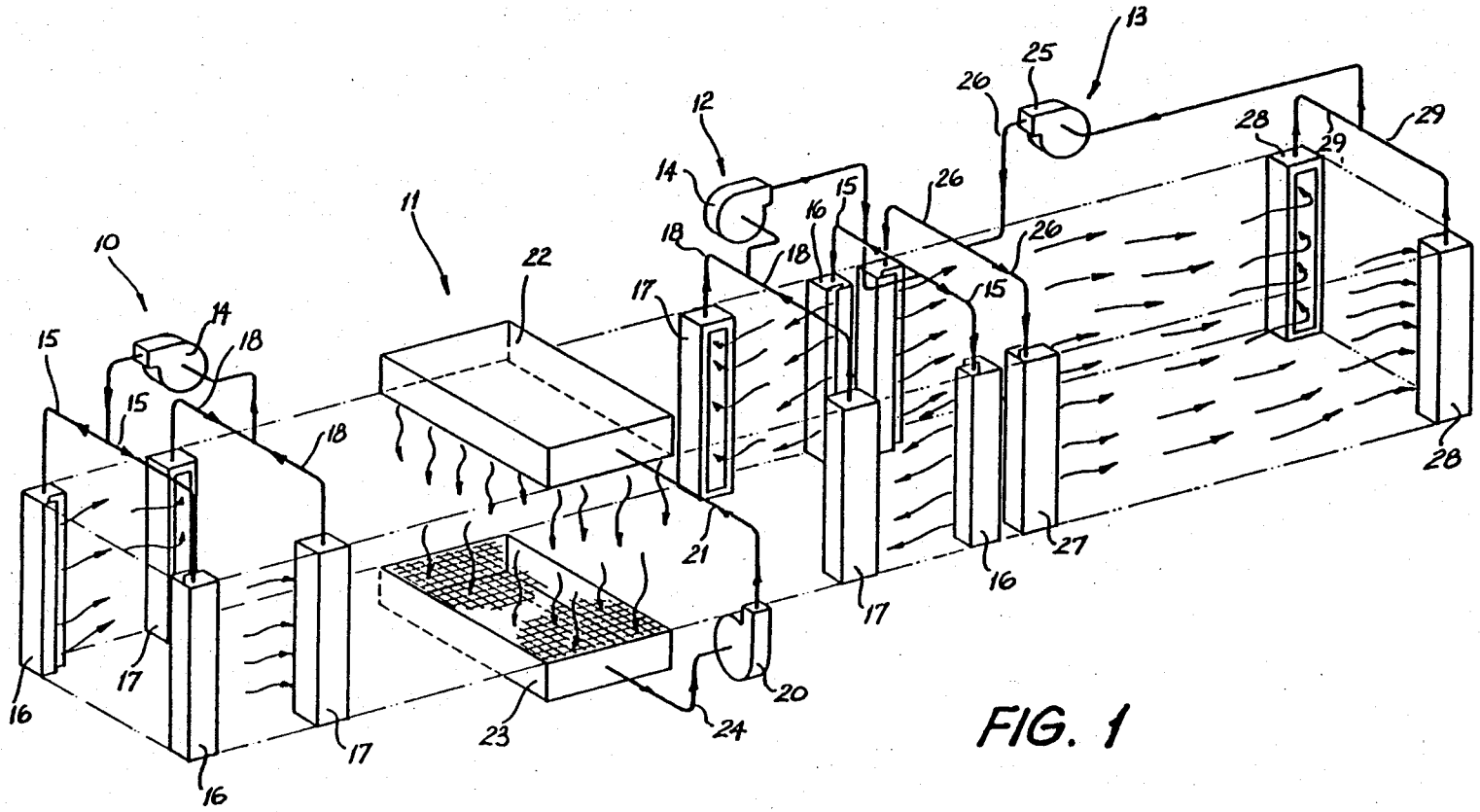
FIG. 1 is a diagrammatic perspective view of apparatus according to the invention.

In the preferred form of the invention apparatus for curing a coating on a substrate is constructed as follows in a configuration wherein the article to which the coating has been applied can be passed progressively through a plurality of operating stations, for example while supported on a continuous conveyor system.

The apparatus comprises four major portions which, in process sequence, comprise an inlet air seal zone 10, a catalytic initial curing zone 11, an outlet air seal zone 12, and a gas blast chamber 13.

The inlet and outlet air seal zones 10 and 12 include similar elements which are given the same reference numerals, the only difference being that the airflow in the outlet zone is directed in the opposite direction to the process path for the purpose of containing the vapour catalyst material in zone 11. Each of the air seal zones comprises a centrifugal fan 14 feeding air via supply ducts 15 to respective upright plenum chambers 16 at the sides of the apparatus from which air issues and follows the path shown in the drawings to be received and drawn into similar air take-up chambers 17 from which the air travels via ducts 18 back to the inlet of the centrifugal fan.

In the catalytic zone a centrifugal fan 20 is used to circulate a vapour catalyst-air mixture, the fan discharging the air along a supply duct 21 to a discharge plenum chamber 22 extending across the top of the zone and from which the gaseous mixture flows downwardly past the product to be positioned in the zone and into a take-up plenum chamber 23. Air is then passed back along return duct 24 to the inlet of the centrifugal fan 20.

The gas blast chamber 13 includes the centrifugal fan 25 discharging air through a duct 26 to outlet plenum chambers 27 which are upright chambers at the upstream end of the chamber and directed for producing a downstream draught of controlled airflow in accordance with the inventive concept. The air is removed downstream at take-up plenum chambers 28 and returned via air-duct 29 to a centrifugal fan 25.

The article to which the coating has been applied, for example by spray painting, is typically suspended from an overhead conveyor and passed progressively through the air seal 10, the catalytic zone 11, the air seal 12 and the gas blast chamber, the speed of the conveyor and the length of each zone or chamber being such as to retain the article in the catalytic zone 11 and the gas blast chamber 13 for predetermined periods of time.

Figure 2:
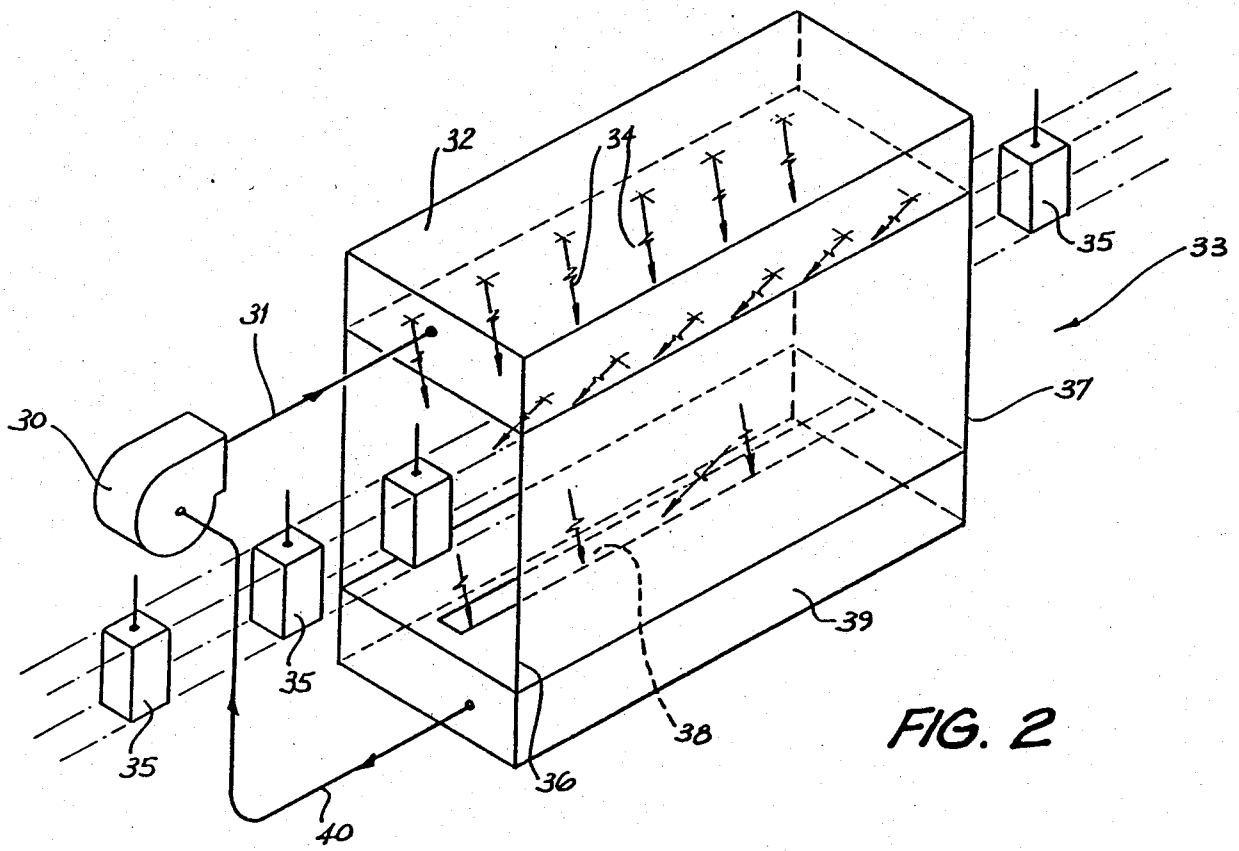
FIG. 2 is a diagrammatic perspective view of an alternative configuration of the gas blast chamber shown in FIG. 1.

Although the gas blast chamber has been shown in FIG. 1 as having an air supply at one end of the chamber and an air outlet at the opposite end, in some situations it is preferred to provide a substantially vertical air flow through the gas blast chamber and shown in the configuration of FIG. 2. In this configuration air is supplied from a circulating fan 30 through a supply duct 31 into a supply plenum chamber 32 above the gas blast chamber 33. The supply plenum chamber 32 incorporates nozzles in the lower parts thereof (not shown) to direct the supply air downwarly in the direction shown by arrows 34 so that the gas blast air impinges on the article contained in the chamber 33 at an acute angle to achieve a scouring effect of the gas blast onto the surface of the coating. The coated goods 35 which are typically suspended from an overhead conveyor (not shown) pass through the chamber 33 from the inlet end 36 to the outlet end 37.

The gas blast air is collected through a lower nozzle 38 into a collection plenum chamber 39 and is returned to the circulating fan 30 by way of duct 40.

The gas blast applied in the manner described above is used to remove most or all of the catalyst remaining in or on the surface coating after passing through the catalytic zone 11.

Although the application of the catalyst has been described thus far as being by way of vapour phase impingement it is also possible to apply the catalyst by electrostatic deposition, once again followed by the gas blast phase to remove catalyst remaining on the coating. In one particular configuration the catalyst and the coating (e.g. paint) may both be applied simultaneously by electrostatic deposition.

The overall effect of the gas blast scouring removal of catalyst will now be described by reference to the following examples, in which Example 1 relates to the prior art method of curing a coating on a substrate by the application of a vapour phase catalyst, Examples 2 and 4 show the effect of increasing the velocity of the impingement of the catalyst containing vapour, and Examples 3, 5 and 6 the effect of applying a gas blast at various velocities and for different periods of time to the coating after the application of the vapour phase, in order to remove remaining catalyst. The results of these Examples are summarised in Table 1 set out hereinafter.

EXAMPLE 1

(a) Zinc phosphate coated steel panels 250 mm long, 100 mm wide and 1.5 thick were spray painted with urethane-resinous hybrid based paint using a conventional air atomisation gun. The air supply was filtered and dried to a 2° C. dewpoint condition.

(b) Two minutes after the spray painting step, the panel was placed in a curing tunnel and the coating was subjected to a vapour catalyst recirculated through the tunnel for a period of two minutes. The vapour catalyst was dimethylethonalamine (DMEA) and the concentration was measured by a calibrated monitor. DMEA was dispersed in air and the air velocity in the curing chamber was measured with an electronic vane type anemometer, the velocity being in this example 0.35 meters per second. The panel was retained under these conditions in the curing tunnel for two minutes.

(c) The test panel was removed from the curing tunnel and allowed to stand in a normal factory atmosphere.

After a further 2 minutes the paint film had skinned on top and was soft or slimy under the skin. This condition did not significantly change over the next 15 minutes. Examination of the panel one hour after removal from the curing chamber showed that bubbling or pin holing of the film had taken place, suggesting that after the film had skinned the release of any catalyst and solvents entrapped in a skin film then ruptured the top membrane.

(d) The panel was allowed to stand in a normal factory atmosphere and hardening or curing of the coating (or film) was considered to have reached an acceptable stage after 240 minutes, however, the film properties were not acceptable because of the bubbling phenomenon.

EXAMPLE 2

The experiment of Example 1 was repeated, but with the sole difference that the air velocity carrying the catalyst vapour was increased to 0.75 meters per second. The results were exactly the same as Example 1 except that the degree of bubbling or pin holing of the coating or film was not as extensive as Example 1 and a final acceptable hardening or curing of the film was achieved in 200 minutes; however, the film properties were not acceptable because of the bubbling phenomenon.

EXAMPLE 3

The experiment of Example 1 was repeated, except that the air velocity carrying the catalyst vapour was increased to 1 meter per second and after the 2 minute period for impingement of catalyst vapour onto the coating, a post-cure step was conducted as follows.

An exhaust fan was operated to purge catalyst vapour from the curing chamber, and a stream of air only was impinged onto the coating for a period of 4 minutes. At the end of this 4 minute period it was found that the paint film was sufficiently cured to the extent that it could be handled lightly but it would not resist heavy finger pressure. There was no evidence of the film skinning and it was considered that after a further 95 minutes standing time in normal factory conditions, the paint film had reached an acceptable level of cure. Thus, an improved paint film was achieved with relatively constant and uniform curing and hardness through the thickness of the film. Furthermore, the results indicate that the combination of the post-cure cycle using simply air for 4 minutes at 1 meter per second in combination with the elevated velocity of the air-catalyst vapour stream used in the curing step demonstrates a useful and significant advance.

EXAMPLE 4

To demonstrate the significance alone of increasing the air-catalyst vapour stream velocity in the cure cycle, Example 1 was repeated but with the exception that the air-catalyst vapour stream velocity was increased to 1 meter per second. When the test panel was removed from the curing tunnel after the 2 minute period, the paint film was tacky and was not dust free. There was no evidence of skinning or bubbling. An acceptable cure through the thickness of the paint film was achieved in 180 minutes, thus a very long period is required to achieve an acceptable cure and this method alone does not solve the total problem.

It is suggested as a theory that entrapped solvent and/or catalyst vapour material in the paint film inhibits curing of the polymer constituting the paint film, and the entrapped material may have a tendency to resoften the polymer.

EXAMPLE 5

Example 3 was repeated but with an increase of the air-catalyst stream velocity in the cure cycle to 1.5 meters per second and the 4 minute post-cure cycle was characterised by the air velocity over the film being increased to 4 meters per second. The test panel was then removed from the curing chamber and it was found that the paint film was free of bubbling and skinning and was in a dust-free state permitting light handling. It was considered that after a further period of 25 minutes standing in a normal factory atmosphere, an acceptable degree of cure through the thickness of the film was achieved and this was considered to be a very advantageous and effective result.

EXAMPLE 6

Example 5 was repeated but with the air velocity in the post-cure cycle being increased to 8 meters per second and upon removal from the curing tunnel after the post-cure step, the test panel was in a dust free state, free of bubbling and skinning and was capable of being handled lightly. After a period of 15 minutes it was considered an acceptable degree of cure through the thickness of the film had been achieved.

TABLE 1

| | Cure Cycle | | Post Cure Cycle | | |
|---|---|---|---|---|---|
| Example | Time (Mins) | Air Velocity (M/Sec.) | Time (Mins) | Air Velocity (M/Sec.) | Result |
| 1 | 2 | .35 | — | — | Bad Bubbling Cure - Not Acceptable |
| 2 | 2 | .75 | — | — | Some Bubbling Cure - Not Acceptable |
| 3 | 2 | 1 | 4 | 1 | No Bubbling Evident Cure - Marginal |
| 4 | 2 | 1 | — | — | No Bubbling Evident - Cure Not Acceptable |
| 5 | 2 | 1.5 | 4 | 4 | No Bubbling Evident - Cure Acceptable |
| 6 | 2 | 1.5 | 4 | 8 | No Bubbling Evident Cure - Good |

From these results it can be seen that the use of a gas blast on the surface coating after the application of the vapour phase catalyst to remove remaining catalyst results in curing of the surface coating in a very short period of time, to a degree of hardness which enables immediate handling for packing or distribution to be carried out. This time saving can result in large economic savings in production situation.

I claim:

1. A method of curing a coating on a substrate wherein at least the initiating of the curing is achieved by the vapour phase or electrostatic application of a catalyst, characterised by the step of applying a gas blast to the coating after the application of the catalyst and before complete cure is effected, substantially removing remaining and/or unused catalyst from the coating.

2. A method as claimed in claim 1 wherein the gas blast is impinged upon the coating at an acute angle thereto, removing the catalyst by a scouring action.

3. A method as claimed in claim 1 wherein the gas blast has a velocity of at least 1.5 meters per second over the surface of the coating.

4. A method as claimed in claim 1 wherein the gas blast comprises an air blast.

5. A method as claimed in claim 1 wherein the gas blast is applied to the coating for at least 4 minutes.

6. A method as claimed in claim 1 wherein the catalyst is applied to the coating by vapour phase impingement.

7. A method as claimed in claim 6 wherein the impingement of the vapour phase material onto the coating is at a velocity of at least one meter per second.

* * * * *